US006609828B2

(12) United States Patent
Schneider et al.

(10) Patent No.: US 6,609,828 B2
(45) Date of Patent: Aug. 26, 2003

(54) METHOD OF MAKING RECLOSABLE PACKAGING

(75) Inventors: John H. Schneider, Frankfort, IL (US); Steven Ausnit, New York, NY (US); Donald L. Crevier, Essex, IL (US); Joel Johnson, Stockbridge, GA (US); Stanley Piotrowski, Schiller Park, IL (US)

(73) Assignee: Illinois Tool Works, Inc., Glenview, IL (US)

( * ) Notice: Subject to any disclaimer, the term of this patent is extended or adjusted under 35 U.S.C. 154(b) by 174 days.

(21) Appl. No.: 09/794,793

(22) Filed: Feb. 27, 2001

(65) Prior Publication Data

US 2001/0005973 A1 Jul. 5, 2001

Related U.S. Application Data

(63) Continuation-in-part of application No. 09/292,256, filed on Apr. 15, 1999, now abandoned.

(51) Int. Cl.[7] ..... B65D 33/00

(52) U.S. Cl. ..... 383/204; 383/61.2; 383/64; 383/66

(58) Field of Search ..... 383/5, 61, 64, 383/66, 203, 204, 61.2

(56) References Cited

U.S. PATENT DOCUMENTS

| | | | | | |
|---|---|---|---|---|---|
| 4,335,817 | A | * | 6/1982 | Bahr | 383/66 X |
| 4,909,017 | A | | 3/1990 | McMahon et al. | |
| 5,681,115 | A | * | 10/1997 | Diederich et al. | 417/222.2 |
| 5,713,669 | A | | 2/1998 | Thomas et al. | |
| 5,806,984 | A | * | 9/1998 | Yeager | 383/66 X |
| 5,954,433 | A | * | 9/1999 | Yeager | 383/66 X |
| 6,264,366 | B1 | * | 7/2001 | Custer | 383/64 X |
| 6,273,607 | B1 | * | 8/2001 | Buchman | 383/64 X |
| 6,290,390 | B1 | * | 9/2001 | Buchman | 383/64 X |
| 6,290,391 | B1 | * | 9/2001 | Buchman | 383/64 X |
| 6,347,885 | B1 | | 2/2002 | Buchman | |
| 6,402,376 | B1 | * | 6/2002 | Bois | 383/64 |

FOREIGN PATENT DOCUMENTS

| | | | | |
|---|---|---|---|---|
| CH | 0675235 | * | 9/1990 | 383/66 |
| GB | 0998967 | * | 7/1965 | 383/66 |
| JP | 405270551 A | * | 10/1993 | 383/63 |

* cited by examiner

*Primary Examiner*—Jes F. Pascua
(74) *Attorney, Agent, or Firm*—Pitney, Hardin, Kipp & Szuch LLP

(57) ABSTRACT

A method of making reclosable packaging utilizes a longitudinally extending web of film material having cutouts therein. A length of zipper strip substantially half the width of the web and having an attached slider is applied transversely across the web of film material with the slider positioned in the cut out. The web is folded longitudinally with the zipper attached to the web and the slider positioned in the cut out. The edges of the web are brought together longitudinally and seamed to form a tube. The opposite ends of the tube are sealed to form the package. The resultant bag has the slider seated in the cut-out where it is readily visible to a consumer.

11 Claims, 2 Drawing Sheets

METHOD OF MAKING RECLOSABLE PACKAGING

CROSS REFERENCE TO RELATED APPLICATIONS

This application is a continuation-in-part of application Ser. No. 09/292,256 filed on Apr. 15, 1999, now abandoned.

BACKGROUND OF THE INVENTION

The present invention relates to reclosable plastic bags and, in particular to a method of manufacturing such packages on form, fill and seal equipment.

Reclosable bags have become increasingly popular both for storage purposes and as primary packaging for foodstuffs and other commodities. The closures for such packaging consist of a pair of profiles having mating interlocking elements and may have webs to facilitate joining the zipper to the package material. A slider may be provided to facilitate opening and closing the zipper.

In U.S. Pat. No. 4,909,017 there is disclosed a method for forming reclosable bags on a form, fill and seal machine wherein the zipper runs transverse to the running direction of the bag making film. While the method disclosed in this reference and improvements that have since been made work fine for slider-less zippers, the method does not readily lend itself to applications where the zipper is provided with a slider to facilitate opening and closing because of difficulties in providing access to the slider in the finished bag.

SUMMARY OF THE INVENTION

In view of the above, it is the principal object of the present invention to provide an improved method for forming reclosable bags having slider operated zippers.

Another object is to provide such a method which provides for a package in which the zipper is readily visible and accessible to a consumer.

A further object is to provide such a method that employs conventional bag making equipment.

The above and other objects and advantages are attained in accordance with the present invention by providing a method of making reclosable packaging wherein a longitudinally extending web of film material is provided with cutouts therein. A length of zipper strip having an attached slider is applied transversely across the web of film material with the slider positioned in the cut out. The web is folded longitudinally with the zipper attached to the web and the slider positioned in the cut out and the edges of the web are longitudinally seamed to form a tube. The opposite ends of the tube are sealed to form the package. The zipper length is substantially half the width of the web.

DETAILED DESCRIPTION OF THE PREFERRED EMBODIMENT

Figure 1:
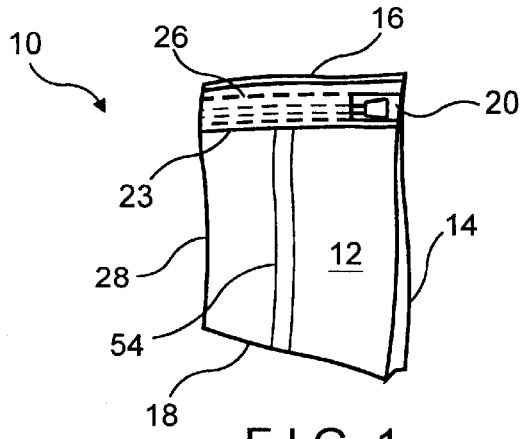
FIG. 1 is a perspective view of a reclosable bag manufactured in accordance with the method of the present application.
Figure 7:
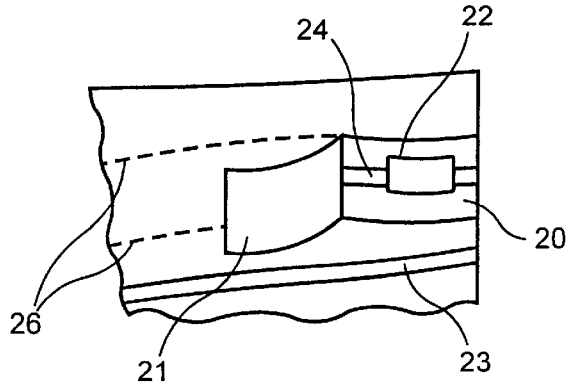
FIG. 7 is an enlarged fragmentary view of an alternative zipper slider cut-out portion.

Reference is now made to the drawings and to FIG. 1 in particular wherein a reclosable bag 10 manufactured in accordance with the present invention is depicted. The bag 10 includes a front wall 12, rear wall 14, top 16 and bottom 18. A cut-out 20 is provided on front wall 12 providing access to slider 22 of zipper 24. A frangible line such as spaced perforation lines 26 extend from the cut-out 20 to the side wall 28 of the bag. When the perforations are ruptured the zipper 24 is exposed over its entire length. Since the slider 22 sits in the cut-out 20, it is readily visible to a consumer who will immediately recognize that not only is bag 10 a zipper bag but it is a zipper bag provided with a slider. Preferably two parallel lines of perforations are provided so as to create a strip that can be removed from one end of the zipper to the other. As shown in FIG. 7, the material to be removed to form the cut-out 20 may be cut only on three sides and left in place as a flap 21 which extends to the spaced perforation lines 26. A user may thus lift the flap 21 and pull back to tear along the perforations to thereby obtain access to the slider and then the zipper.

The bag 10 is formed from a web of film material 30 which has cut-outs 20 and pairs of perforation lines 26 spaced along the web at bag length intervals with the perforations extending transversely across the web to provide a removable strip along the wall of the bag. The combined length of the cut-out 20 and perforation line 26 is approximately one half the width of the web 30 so that the cut-out and perforations will extend across the front of the bag from side to side, as shown.

Figure 6:
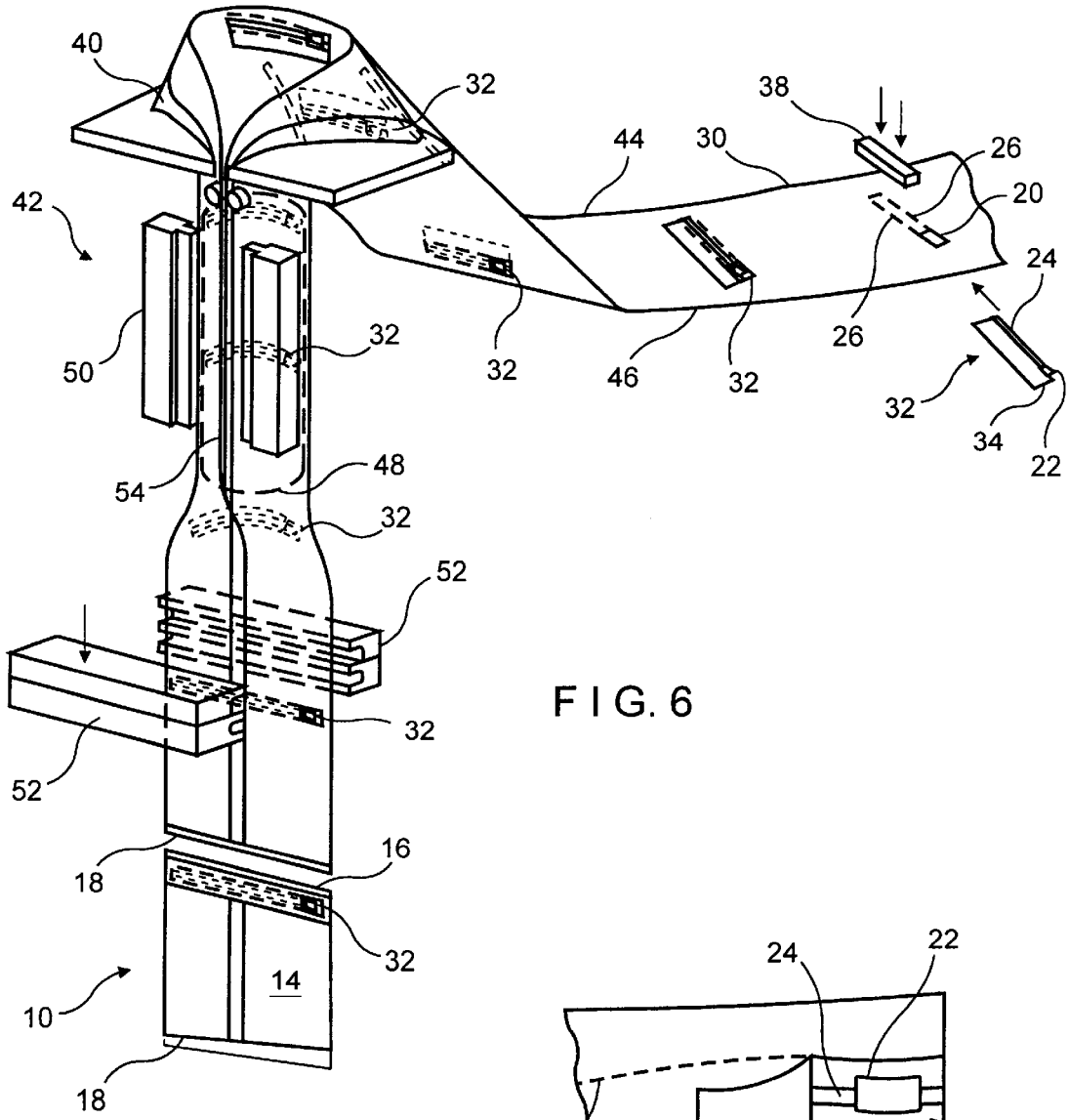
FIG. 6 is a simplified schematic perspective view of a form, fill and seal machine utilized in accordance with the method of the present invention.

Reference is now made to FIG. 6 wherein the method of forming bag 10 is depicted. As shown, the web of film material 30 is brought past a zipper application station where lengths of zipper 32 with attached sliders are fed onto the film web with the slider 22 captured in cut-out 20 and the zipper tracks positioned between the set of perforations 26. The zipper web is then attached, or at least tacked to the film by a sealing bar 38 to maintain the zipper profiles and slider in that position. The zipper profiles and the slider may have any of many well known configurations although it is advantageous that at least one of the zipper profiles include a leading flange 34 to facilitate attaching the zipper to the film.

Once the zipper strip 34 is attached to the film 30, the remaining steps in the formation of the bag are generally as shown and described in the aforementioned U.S. Pat. No. 4,909,017. Namely, a zipper strip 32 having an attached slider 22 is fed onto web 30 with the slider 22 oriented and positioned to overlie a cut-out 20 of the web. The zipper is secured or tacked in position to move with the web over a forming collar 40 of a form, fill and seal machine 42. The forming collar serves to direct the web about a fill tube 48 and to bring the opposite longitudinal edges 44, 46 of the web together. The edges 44, 46 are longitudinally seamed at 54 by sealing bars thereby forming a package tube which flattens as the package tube clears the filling tube 48 of the machine. The lower cross seal having been formed as indicated below. Contents are dropped from the filling tube and, when filled, transverse sealing bars 52 are closed to perform the following functions: seal the zipper strip to the front and rear walls of the flattened package tube; seal the package tube transversely above the zipper strip to form the top 16 of a filled package 10; sever the filled package 10 from the package tube and form the bottom transverse seal 18 for the next package and, if required to provide a breakable seal, such as a peel seal 23, below the zipper-to-wall seal. The process is then repeated.

Figure 2:
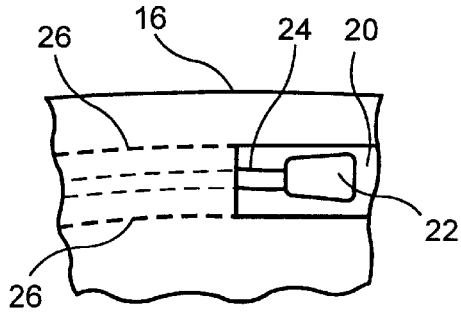
FIG. 2 is an enlarged fragmentary view of the zipper slider cut-out portion of the bag of FIG. 1.

The resultant package 10 is as shown in FIGS. 1 and 2. The package zipper 24 extends across the top of the package with the slider 22 in cut-out 20. A consumer purchasing the package becomes readily aware that not only does the package contain a zipper but that the zipper has a slider. To open the package the perforation lines 26 must be ripped either before the slider is moved or as a result of the slider being moved. In either event, the consumer would have clear evidence of the package having been opened.

Figure 3:
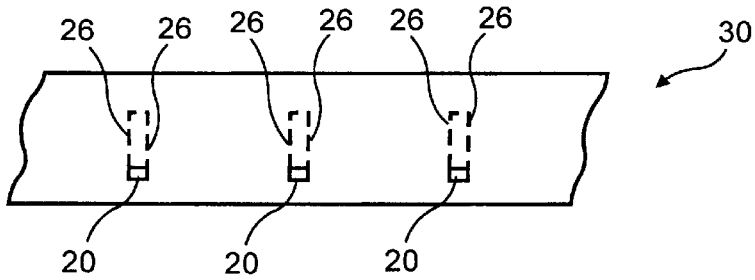
FIG. 3 is a top plan view of a web of film material used in the manufacture of the bag of FIG. 1.
Figure 4:
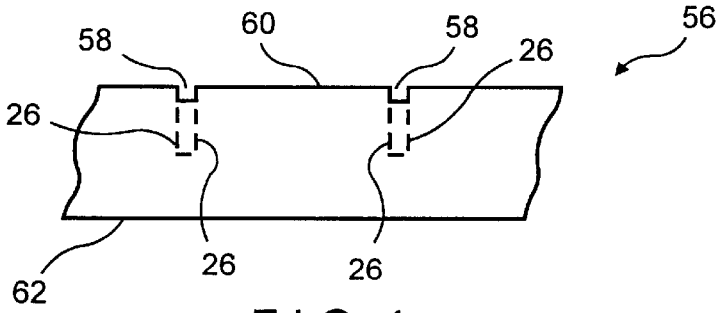
FIG. 4 is a top plan view of an alternative web configuration.

In the package of FIG. 1, the longitudinal seam 54 extends down the center of the back panel 14 of the filled package and was made from the web shown in FIG. 3. A modified film web 56 is shown in FIG. 4. Web 56 would be used to form packages where the longitudinal seam is at an edge of the package rather than running down the center of he package. In this case, the cut-outs 58 are at an edge 60 and the perforations 26 extend toward the opposite edge 62. Again the combined length of each set of cut-out and perforations is substantially equal to half the width of the web. Again the zipper strips would be applied to web 56 so that each slider 22 over lies a cut-out 58. The resultant bag would appear the same as bag 10 except that seam 54 would be at an edge of the bag rather than down the center of the bag.

Figure 5:
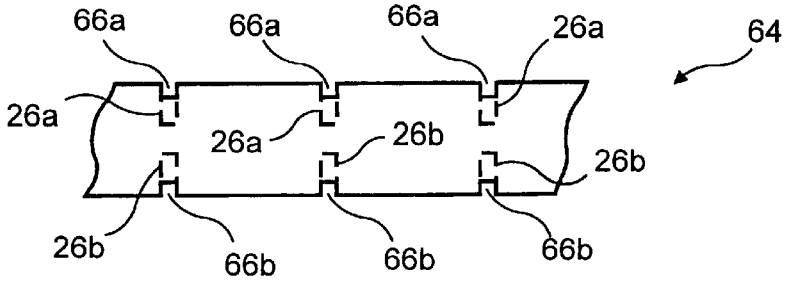
FIG. 5 is a top plan view of another alternative web configuration.

A further modification of the film web is depicted in FIG. 5. In this case the film web 64 has cut outs 66*a* and 66*b* extending from both edges and perforations 26*a* and 26*b* extending from each cut-out 66*a* and 66*b* toward the opposite edge. The combined length of each set of cut outs (66*a* and 66*b*) and perforations (26*a* and 26*b*) is substantially equal to length of zipper strip 32. The zipper strip is positioned in the middle of the web between each set of perforations and it is not until the film web is folded that the slider 22 is positioned within the cut-out. The package is formed as shown in FIG. 6 and described above. The resultant bag is the same as shown in FIG. 1 except that the cut-out appears on the side of the bag containing longitudinal seam 54 (i.e. the rear of he package shown in FIG. 1). Also the cut-out (and hence the slider) appear in the center, rather than at an edge of the package. Accordingly, the slider of zipper strip 32 would have to be moved to the center of the zipper strip prior to attaching the zipper to web 64. In still another modification the perforations may extend completely across the web. In this case, removing the strip between the perforations would expose both the front and the back sides of the zipper making access to the slider that much easier. In such case, two cutouts may be provided to expose the slider from both the front and rear of the package.

Thus, in accordance with the above, the aforementioned objectives are effectively attained.

Having thus described the invention, what is claimed is:

1. A reclosable package having a front wall, arear wall, a top and a bottom, a zipper strip having portions attached to said front and rear walls, said zipper strip extending across said top of said package, a slider mounted on said zipper strip, a flap in said one of said front and rear walls and a cut-out in one of said front and rear walls being formed behind said flap, said slider being positioned within said cut-out.

2. The reclosable bag in accordance with claim 1 further comprising a frangible line extending along said cut-out containing wall from said cut-out in line with said zipper, the overall length of said frangible line and cut-out being substantially equal to length of said zipper strip.

3. The reclosable bag in accordance with claim 2 wherein said cut-out is at a side edge of said cut-out containing wall and said frangible line extends substantially to an opposite side edge.

4. The reclosable bag in accordance with claim 2 wherein said frangible line comprises a line of perforations.

5. The reclosable bag in accordance with claim 2 wherein said frangible line comprises a pair of spaced apart lines of perforations.

6. The reclosable bag in accordance with claim 5 further comprising a flap in said one of said front and rear walls, said cut-out being formed behind said flap and said perforation lines extend from a connection of said flap to said wall whereby said perforation lines may be ruptured by pulling upon said flap to thereby remove the wall material between said perforation lines and expose said zipper strip.

7. The reclosable bag in accordance with claim 2 further comprising a flap in said one of said front and rear walls, said cut-out being formed behind said flap and said frangible line extends from a connection of said flap to said wall.

8. The reclosable bag in accordance with claim 1, further comprising a longitudinal seam extending down a center of said package.

9. The reclosable bag in accordance with claim 8, wherein said cut-out is in one of said front and rear walls including said longitudinal seam.

10. The reclosable bag in accordance with claim 9, wherein said cut-out is in said center of said package.

11. The reclosable bag in accordance with claim 1, further comprising a longitudinal seam extending down an edge of said package.

* * * * *